United States Patent [19]

Gould

[11] 4,126,835

[45] Nov. 21, 1978

[54] BALANCED PHASE SEPTUM POLARIZER

[75] Inventor: Harry J. Gould, Cupertino, Calif.

[73] Assignee: Ford Motor Company, Dearborn, Mich.

[21] Appl. No.: 808,206

[22] Filed: Jun. 20, 1977

[51] Int. Cl.[2] ..... H01P 1/16

[52] U.S. Cl. ..... 333/21 A; 333/98 R

[58] Field of Search ..... 333/21 R, 21 A

[56] References Cited

U.S. PATENT DOCUMENTS

| | | | |
|---|---|---|---|
| 3,284,725 | 11/1966 | Bowman | 333/21 R X |
| 3,955,202 | 5/1976 | Young | 333/21 A X |

OTHER PUBLICATIONS

Chen et al., A Wide-Band Square-Waveguide Array Polarizer, IEEE Trans. on A & P, May 1973, pp. 389-391.

*Primary Examiner*—Paul L. Gensler

*Attorney, Agent, or Firm*—Robert W. Brown; Clifford L. Sadler

[57] ABSTRACT

A balanced phase septum polarizer for converting a linearly polarized microwave signal to a circularly polarized microwave signal and vice versa. The septum polarizer includes a first waveguide, capable of propagating a circularly polarized microwave signal, and a septum that divides this waveguide into second and third waveguides each of which is capable of propagating a linearly polarized electric field microwave signal. The septum extends between opposite sides of the first waveguide and has an edge that is shaped to produce an inflection point in the phase angle vs. frequency function for the orthogonal electrical field components of the circularly polarized microwave signal. This results in a "balanced phase angle" relationship that permits reduction of the septum polarizer VSWR and improves significantly the axial ratio of the circularly polarized microwave signal.

10 Claims, 12 Drawing Figures

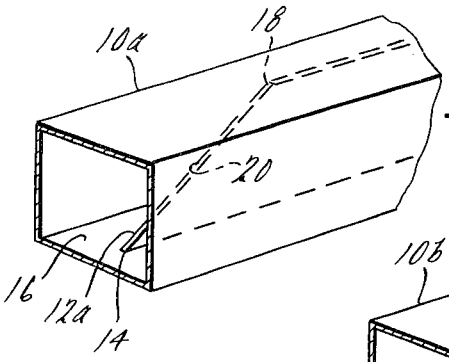
FIG. 1.
(Prior Art)
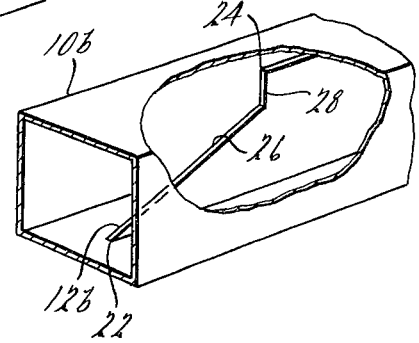
FIG. 2.
(Prior Art)
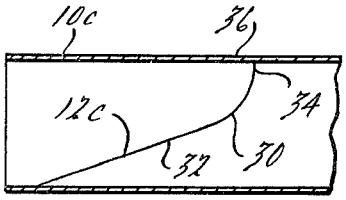
FIG. 3.
(Prior Art)
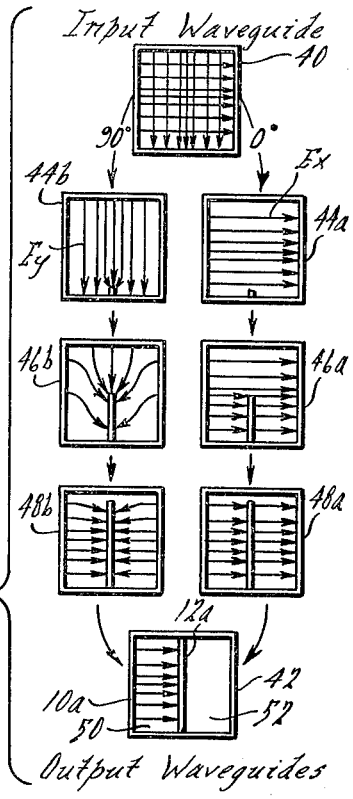
FIG. 4.
(Prior Art)
FIG. 5.
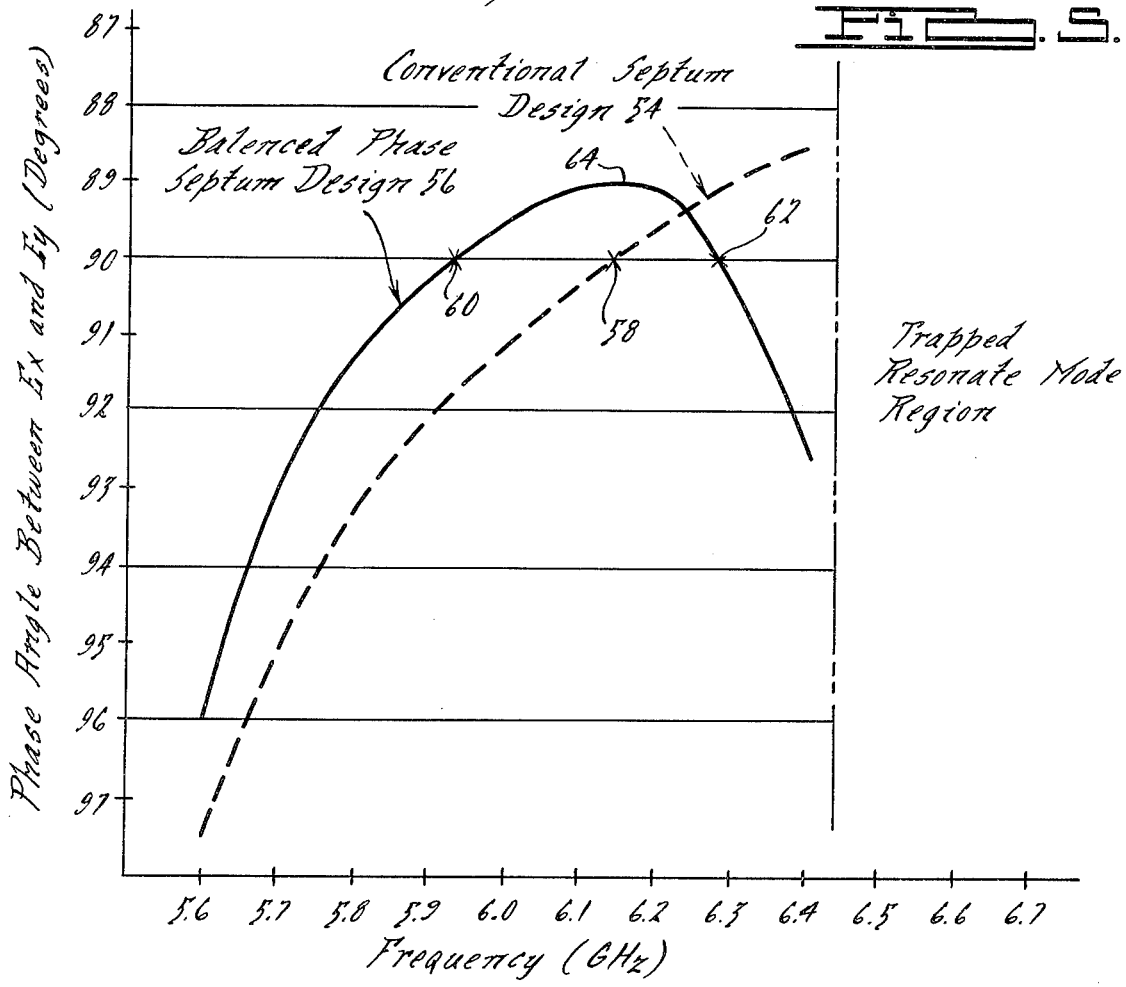

BALANCED PHASE SEPTUM POLARIZER

BACKGROUND

This invention relates to a balanced phase septum polarizer for converting a linearly polarized microwave signal to a circularly polarized microwave signal and vice versa.

A septum polarizer usually is a three-port waveguide device. It may be formed from circular waveguide, but more typically is formed by two rectangular waveguides that have a common wide or H-plane wall. The two rectangular waveguides are transformed by a sloping septum into a single square waveguide. Various prior art septum polarizer designs are illustrated and described in U.S. Pat. No. 3,958,193, issued May 18, 1976 to James V. Rootsey, assigned to Aeronutronic Ford Corporation, now Ford Aerospace & Communications Corporation, the assignee of the present invention.

In a septum polarizer, a linearly polarized transverse electric field microwave signal is converted, through the action of the septum, into a circularly polarized (CP) microwave signal and vice versa. The linearly polarized signal is introduced into one of the two rectangular waveguide ports and produces in the square waveguide port a microwave signal having either right-hand circular polarization (RHCP) or left-hand circular polarization (LHCP). Whether RHCP or LHCP is produced depends upon which of the two rectangular waveguide ports is excited. It is possible and in some applications very desirable to introduce simultaneously in both of the rectangular waveguide ports linearly polarized signals to produce in the square waveguide port both RHCP and LHCP signals or vice versa. The two linearly or circularly polarized signals may constitute separate information channels. If the RHCP and LHCP signals co-existing in the square waveguide port have perfect circular polarization characteristics, they are completely isolated from one another and there is no interference between them.

A perfect CP signal has a rotating electric field that can be regarded as the vector resultant of two orthogonal components $E_x$ and $E_y$ having sinusoidally varying magnitudes that are exactly equal in amplitude but 90° out of phase with one another. The closer simultaneously existing RHCP and LHCP signals come to the perfect CP signal, the greater is the isolation between them. The axial ratio AR is the ratio of $E_x$ to $E_y$ and is an indication of the degree to which a CP signal has departed from the ideal. In dB, the axial ratio AR is equal to 20 log $E_x/E_y$. Perfect CP signals have an AR of 0 dB.

The problem associated with prior art septum polarizers is their inability to provide low axial ratios over a moderately wide frequency band and also to provide a low voltage standing wave ratio (VSWR) over such band. In order to convert a linearly polarized signal to a CP signal or vice versa, the septum of a polarizer must produce an approximate 90° phase shift between one of the orthogonal components of the CP signal electric field and the linear electric field in the rectangular waveguide port. Prior art septum designs provide a phase-shift-angle vs. frequency function that has no inflection point in its slope. In other words, the phase shift angle, as a function of frequency over the useful frequency range of the polarizer, has a rate of change or slope that remains either positive or negative (Whether the scope is positive or negative depends upon the conditions selected as a reference.). The phase angle deviations from 90° produce axial ratio increases of about 0.15 dB/degree difference from 90°.

SUMMARY OF THE INVENTION

A septum polarizer according to the invention comprises a first waveguide capable of supporting propagation of a circularly polarized microwave signal and a septum that divides the first waveguide into second and third waveguides each of which can support propagation of linearly polarized transverse electric field microwave signal. The septum extends from one side to the opposite side of the first waveguide and has an edge that begins at a first point located on the one side of the first waveguide. The septum edge terminates at a second point located on the opposite side of the first waveguide. The septum edge is shaped to produce an inflection point in the phase angle vs. frequency function for the orthogonal electric field components of the circularly polarized microwave signal whose propagation is capable of being supported by the first waveguide.

In the preferred form of the septum polarizer, the first and second points mentioned in the preceding paragraph are spaced from one another reltive to the direction of propagation of microwave signals in the waveguides and the septum edge includes a step-shaped portion. The step-shaped portion is located adjacent one of the points. Also, in the preferred form, the septum edge has a concave curved portion that extends between the step-shaped portion and the other of the points. The concave curved portion of the septum edge has a first curved portion and a second curved portion, the first curved portion being located adjacent the step-shaped portion and being defined by a radius or radii substantially smaller than the radius or radii defining the second curved portion.

These and other features of the balanced phase septum polarizer of the invention may be better understood by reference to the detailed description which follows and to the drawings.

BRIEF DESCRIPTION OF THE DRAWINGS

FIGS. 1–3 illustrate various prior art septum polarizers;

FIG. 4 illustrates the electric fields in a septum polarizer in various planes spaced along and perpendicular to the longitudinal axis of the septum polarizer;

FIG. 5 is a graph of the phase angle between orthogonal electric field components vs. frequency for CP microwave signals in both a conventional septum polarizer and the balanced phase septum polarizer of the invention;

DETAILED DESCRIPTION

Figure 8:
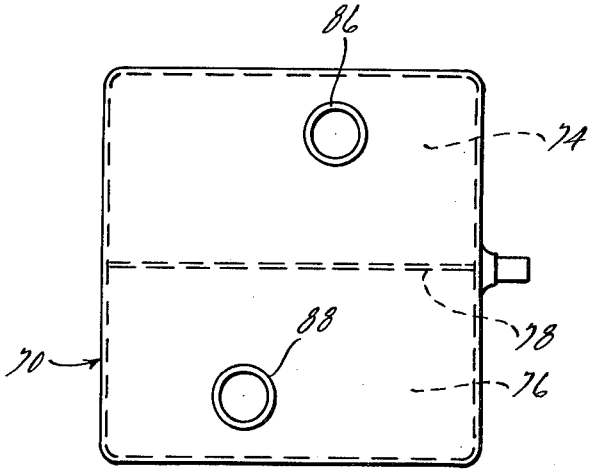
FIG. 8 is an end view of the septum polarizer of FIG. 6.
Figure 9:
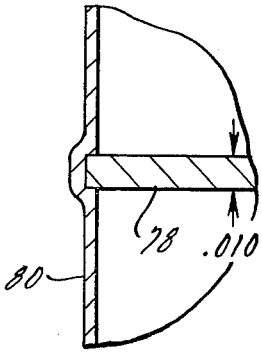
FIG. 9 is a partial sectional view taken along the line 9—9 in FIG. 7.

With reference now to the drawings, wherein like numerals refer to like parts in the several views, there are shown in FIGS. 1–3 prior art septum polarizers formed from square waveguide sections 10*a*, 10*b* and 10*c*. These square waveguide sections are divided, respectively, by septums 12*a*, 12*b* and 12*c*. Thus, each of the square waveguides is divided into two rectangular waveguides by a septum that constitutes a common H-plane wall for the two rectangular guides. The septums are made of electrically conductive material.

In FIG. 1, the septum begins at point 14 on the wall 16 of waveguide 10*a* and terminates at point 18 on the opposite wall thereof. The septum edge 20 is of straight configuration.

In FIG. 2, the septum begins at point 22 on one wall of the waveguide and terminates at point 24 on the opposite wall. The septum has a straight tapered portion 26 and a straight, but transverse, portion 28.

The septum polarizer of FIG. 3 is similar to that of FIG. 2 except that there is a curved transition 30 between a tapered straight edge 32 of the septum and the point 34 at which the septum engages the wall 36 of the square waveguide 10*c*.

FIG. 4 shows cross-sections of a septum polarizer of the type illustrated in FIG. 1 at five different points along the longitudinal axis of the square waveguide 10*a*. The arrows inside the sections show the electric field vectors. Section 40 lies in a transverse plane passing through the point 14, and section 42 lies in a transverse plane passing through the point 18. The square waveguide in its portion preceding the septum 12*a* is to be regarded as transmitting a CP signal being propagated away from the observer at section 40 and toward section 42. This CP wave can be characterized as including orthogonal electric field components $E_x$ and $E_y$, there being a 90° phase difference between these orthogonal electric field components. The progress of the electric field component $E_x$ through the septum polarizer is illustrated by the field lines in sections 44*a*, 46*a* and 48*a* whereas the progress of the orthogonal $E_y$ electric field component is illustrated in sections 44*b*, 46*b* and 48*b*. Of course, the electric fields in the septum polarizer at sections 44, 46 and 48 are the vector resultant of the $E_x$ and $E_y$ fields.

As the $E_x$ electric field component progresses through the septum polarizer, its direction remains unchanged. However, as the $E_y$ signal progresses through the septum polarizer, the field lines are distorted until, at section 48*b*, $E_y$ field lines become parallel with the $E_x$ field lines and are divided into two portions oppositely directed on opposite sides of the septum. At section 42, the septum 12*a* divides the square waveguide 10*a* into two rectangular waveguide portions 50 and 52. Tthe $E_y$ component in rectangular waveguide portion 52 is oppositely directed to the $E_x$ component herein and these electric field components cancel one another. The $E_y$ component in rectangular waveguide portion 50, however, is additive with respect to the $E_x$ component therein and as a result, a linearly polarized signal is contained in rectangular waveguide portion 50.

If the circularly polarized signal illustrated at section 40 is ideal, that is, if its $E_x$ and $E_y$ components are of equal magnitude and if these components are exactly 90% out of phase, then a circularly polarized signal of opposite hand may be introduced into the waveguide and this second circularly polarized signal will not interfere with the first. With the direction of propagation previously mentioned, the second circularly polarized signal would be transformed to a linearly polarized signal appearing in rectangular waveguide portion 52 at section 42. Linearly polarized microwave signals introduced into rectangular waveguide portions 50 and 52 produce LHCP and RHCP signals in the square waveguide portion at section 40.

The present invention improves over prior art septum polarizers in that it provides, over a relatively wide frequency band, a septum polarizer for converting linearly polarized signals to circularly polarized signals and vice versa without the accompanying high axial ratios that have characterized prior art septum polarizers. This is of importance because high axial ratios in the circularly polarized signals cause interference between concurrently propagated LHCP and RHCP signals. This interference can preclude the use of such simultaneous transmission in communication systems, an undesirable situation since simultaneous propagation of LHCP and RHCP signals effectively doubles the capacity of the microwave transmission system.

FIG. 5 is a graph of the phase angle between the orthogonal $E_x$ and $E_y$ electric field components of a microwave signal vs. the frequency thereof for a septum polarizer of conventional design and for a balanced phase septum polarizer designed in accordance with the invention. The dashed line 54 in FIG. 5 is the phase angle vs. frequency response for the conventional septum polarizer and the line 56 illustrates such response for a balanced phase septum polarizer of a design substantially similar to that of the preferred embodiment illustrated in FIGS. 6–11. It may be seen that for the conventional septum design, the phase angle between the orthogonal electric field components $E_x$ and $E_y$ is the ideal 90° only at point 58 corresponding to a signal frequency of about 6.15 GHz. Curve 54 is a monotonic function, that is, as the frequency increases, the phase angle never decreases prior to the frequency reaching the trapped resonant mode region which, in FIG. 5, occurs at a frequency of about 6.44 GHz. Each degree of variation of the phase angle of 90° produces an axial ratio increase of about 0.15 dB. The conventional septum polarizer phase angle is within 90° ± 1° over the frequency range from about 6.0 to 6.3 GHz.

The balanced phase septum polarizer has a phase angle vs. frequency response that is exactly 90° at two points 60 and 62. The phase response curve 56 has an inflection point at 64 and thus is not monotonic as is the case with the phase angle vs. frequency response of prior are septum polarizers. It should be noted that the balanced phase septum polarizer curve 56 exhibits a phase angle of 90° ± 1° over the frequency range from about 5.8 to 6.42 GHz, a substantial improvement over the conventional design.

With particular reference now to FIGS. 6–11, there is shown a preferred embodiment of a balanced phase septum polarizer, generally designated by the numeral 70, suitable for use in the frequency range from 5.7 to 6.3 GHz with an axial ratio over this band of 0.12 dB and a VSWR of 1.07. The septum polarizer 70 has a first square waveguide portion 72 that is divided into second and third waveguide portions 74 and 76 by a septum 78 made from a conductive material. The rectangular waveguide portions 74 and 76 are capable of supporting the propagation of a linearly polarized transverse electric field microwave signals and the square waveguide portion 72 is capable of supporting the propagation of CP microwave signals. The material used to fabricate the square waveguide portion of the septum polarizer must be electrically conductive on the interior waveguide surfaces. A carbon fiber reinforced material or an electroformed nickel layer of 0.004 inch thickness having an electroflashed coating of about 0.004 inch thick copper is preferred.

The septum 78 extends between opposite waveguide walls 80 and 82. The septum begins on the waveguide wall 80 at a point 90 (FIG. 7) and terminates on the opposite wall 82 at a point 92 that is spaced, with respect to the longitudinal axis of the septum polarizer, from the point 90. The edge 94 of the septum is shaped to produce an inflection point in the phase-angle vs. frequency function for the orthogonal electric field components of a circularly polarized microwave signal whose propagation is capable of being supported by the square waveguide portion 72. The dimensions provided in FIGS. 7 and 9–11 are in inches and have been empirically determined to be suitable for the frequency band mentioned above. The septum polarizer has an end wall 84 with input/output ports 86 and 88 provided for connection to a suitable coaxial-transmission-line-to-rectangular-waveguide coupler, such as the coupler described in the inventor's patent application Ser. No. 732,688, now U.S. Pat. No. 4,071,833 entitled "Apparatus for Coupling Coaxial Transmission Line to Rectangular Waveguide".

Between the points 90 and 92, which are spaced from one another relative to the direction of propagation of microwave signals in the waveguides, is located a step-shaped portion 96 in the septum edge 94. The step-shaped portion 96 is located adjacent to the point 92, and a concave curved portion of the septum edge 94 extends from the step portion 96 to the point 90. This concave curved portion has portions 98 and 100 of different radii, the radius of portion 98 being substantially greater than that of portion 100. The stepped portion 96 has a first straight portion 102 and a second straight portion 104 that are transverse to the direction of microwave propagation. A straight portion parallel to the direction of propagation interconnects portions 102 and 104 of the spetum edge.

Figure 10:
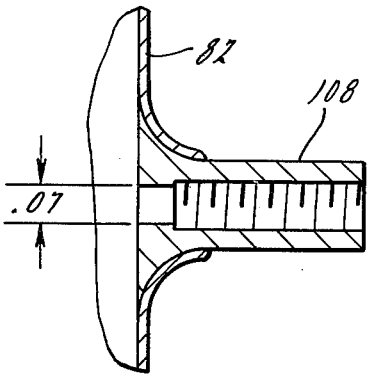
FIG. 10 is a partial sectional view of a phase angle adjustment device in the septum polarizer, this section being taken along the line 10—10 in FIG. 7.
Figure 11:
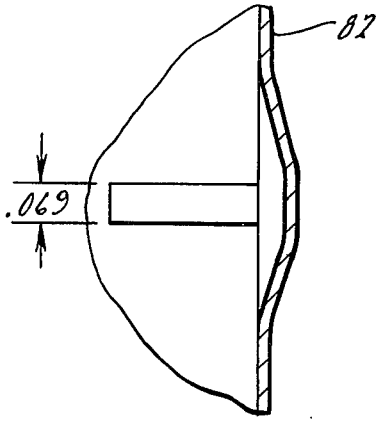
FIG. 11 is a sectional view taken along the line 11—11 in FIG. 7 and illustrates a fixed tuning device in the septum polarizer.
Figure 6:
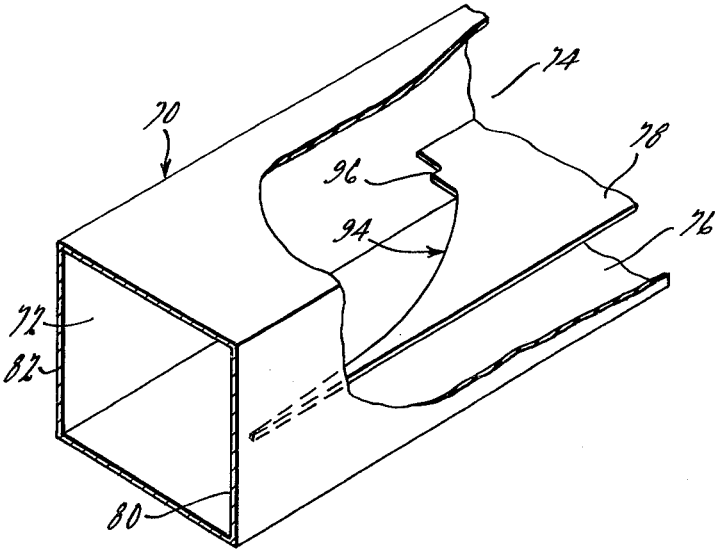
FIG. 6 is a perspective drawing of a balanced phase septum polarizer according to the invention.
Figure 7:
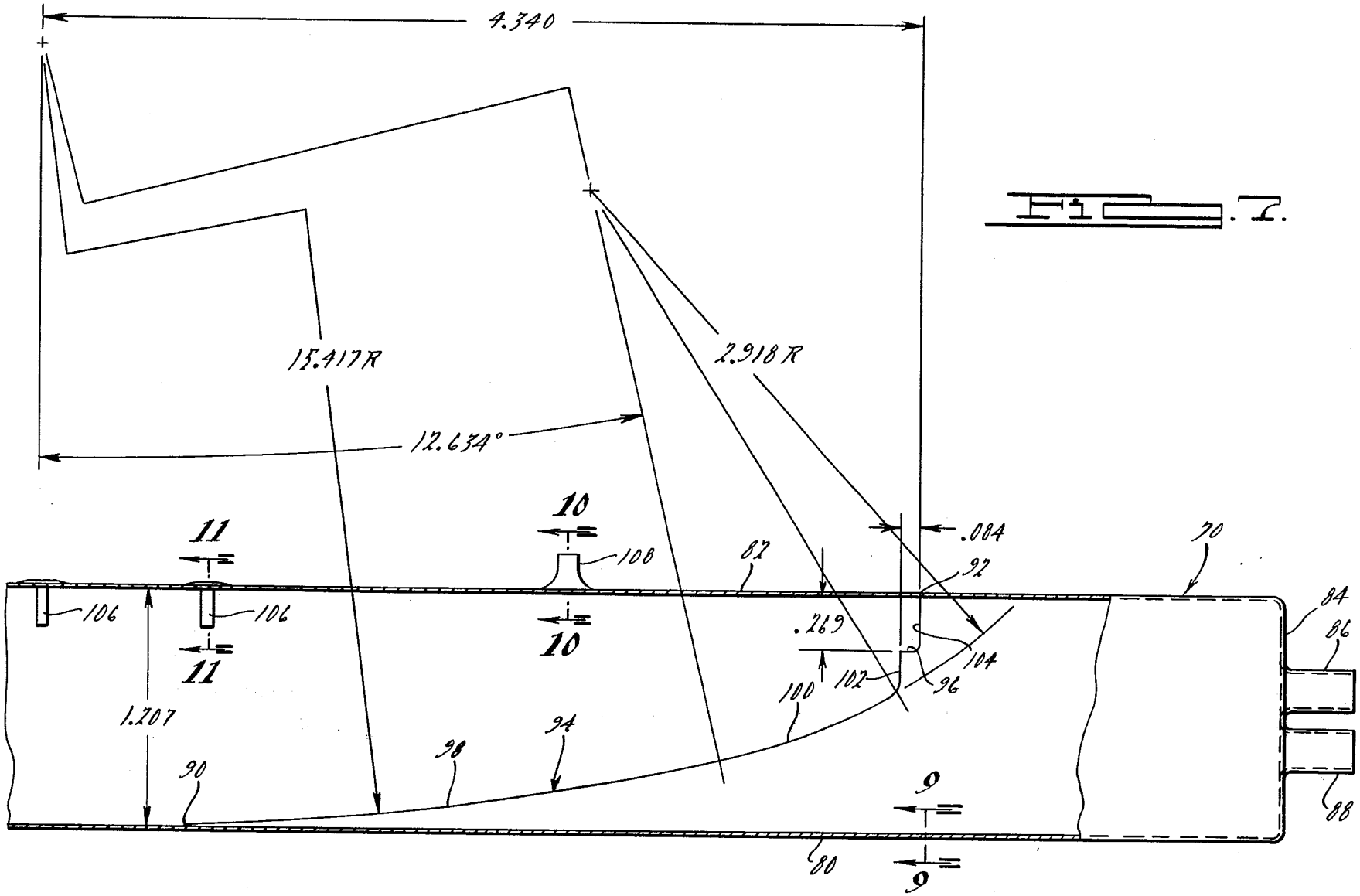
FIG. 7 is a sectional plan view of the septum polarizer of FIG. 6.

The square waveguide portion 72 of the balanced phase septum polarizer 70 includes fixed tuning pins 106 that may be arranged as shown in FIG. 11. Means 108, best seen in FIG. 10, are provided for receiving a variable length tuning pin (not shown) for adjusting the phase angle vs. frequency response of the septum polarizer.

Figure 12:
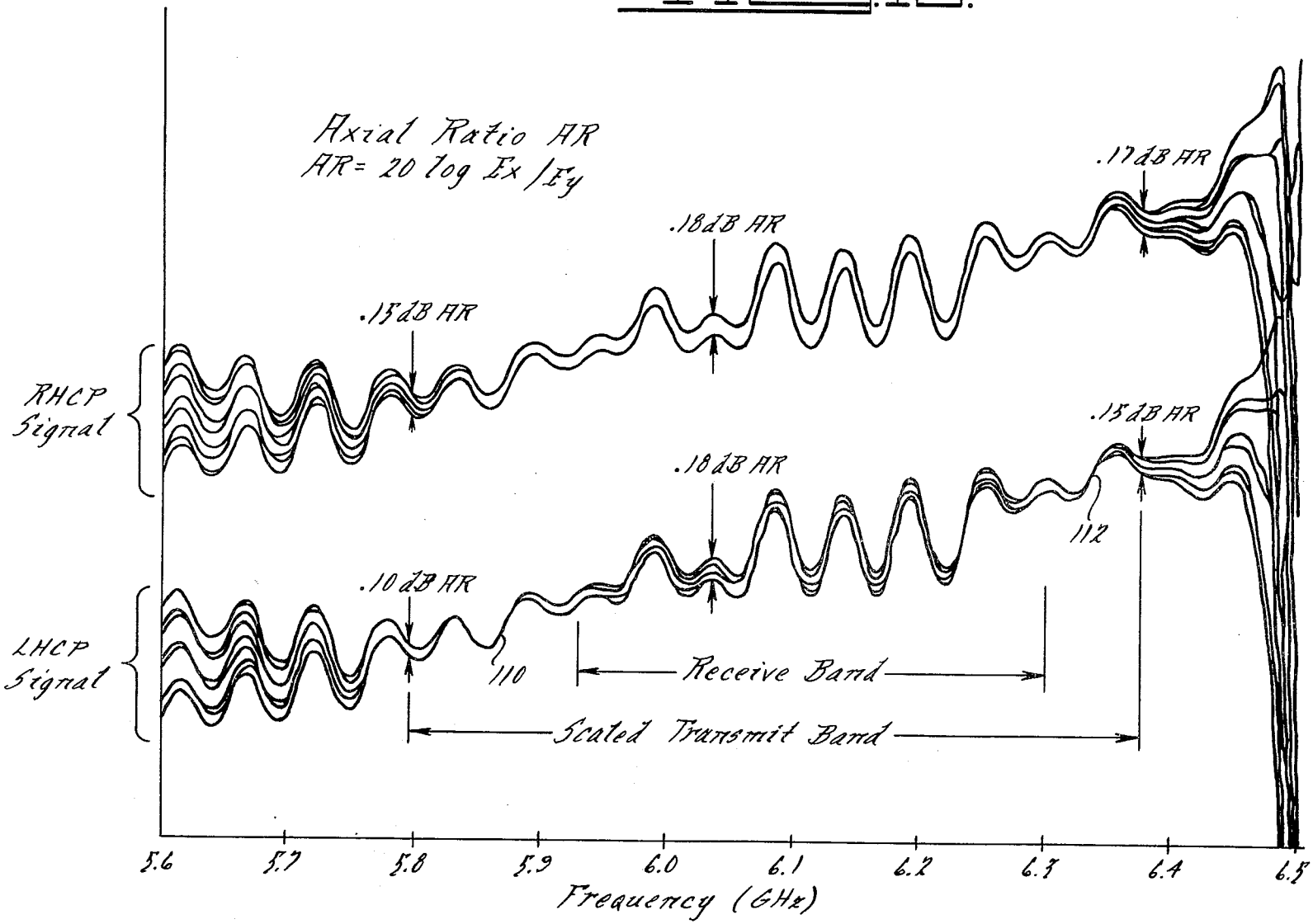
FIG. 12 is a graph of axial ratio AR in dB vs. frequency for both RHCP and LHCP microwave signals in a septum polarizer constructed according to the invention.

With particular reference now to FIG. 12, there is shown a graph illustrating the axial ratio response vs. frequency for a balanced phase septum polarizer constructed in accordance with the invention. The graph is based on measurements of the orthogonal electric field components $E_x$ and $E_y$ over the indicated frequency range for both RHCP and LHCP signals in the septum polarizer. The axial ratios are in dB and are indicated by the peak-to-peak variations between the oscillatory patterns illustrated in FIG. 12. The very low axial ratios at points 110 and 112 should be noted. These very low axial ratios occur at frequencies of about 5.87 and 6.3 GHz, respectively, and indicate that there is at least one inflection point in the phase angle vs. frequency function of the septum polarizer. The low axial ratio points 110 and 112 occur where the phase angle difference between the orthogonal electric field components of the CP signal in the septum polarizer is 90°.

Based upon the foregoing description of the invention, what is claimed is:

1. A septum polarizer for converting a linearly polarized microwave signal to a circularly polarized signal and vice versa, said septum polarizer comprising:

a first waveguide, said first waveguide being capable of supporting propagation of a circularly polarized microwave signal;

a septum dividing said first waveguide into second and third waveguides each of which is capable of supporting propagation of a linearly polarized transverse electric field microwave signal, said septum extending from one side to the opposite side of said first waveguide, said septum having an edge that begins at a first point, said first point being located on said one side of said first waveguide, said septum edge terminating at a second point, said second point being located on said opposite side of said first waveguide, said first and second points being spaced from one another relative to the direction of propagation of microwave signals in said waveguides, and said septum edge having at least one step-shaped portion and at least one concave curved portion, said septum edge causing an inflection point to be produced in the phase angle vs. frequency function of the orthogonal electric field components of the circularly polarized microwave signal whose propagation is capable of being supported by said first waveguide.

2. A septum polarizer according to claim 1 wherein said step-shaped portion of said septum edge is located adjacent one of said points.

3. A septum polarizer according to claim 2 wherein said concave curved portion of said septum edge extends between said step-shaped portion thereof and the other of said points.

4. A septum polarizer according to claim 3 wherein said concave curved portion of said septum edge includes a first curved portion and a second curved portion, said first curved portion being located adjacent said step-shaped portion and being defined by a radius or radii substantially smaller than the radius or radii defining said second curved portion.

5. A septum polarizer according to claim 4 wherein said step-shaped portion of said septum edge includes first and second straight portions extending in a direction transverse to the direction of propagation in said waveguides.

6. A spetum polarizer according to claim 1 wherein said concave curved portion of said septum edge extends between said step-shaped portion thereof and the other of said points.

7. A septum polarizer according to claim 6 wherein said concave curved portion of said septum edge includes a first curved portion and a second curved portion, said first curved portion being located adjacent said stepshaped portion and being defined by a radius or radii substantially smaller than the radius or radii defining said second curved portion.

8. A septum polarizer according to claim 7 wherein said step-shaped portion of said septum edge includes first and second straight portions extending in a direction transverse to the direction of propagation in said waveguides.

9. A septum polarizer according to claim 1 wherein said step-shaped portion of said septum edge is located between said first and second points, said septum edge also having first and second curved portions located between said first and second points.

10. A septum polarizer according to claim 9 wherein said first and second curved portions are concave and defined by radii of substantially different size.

* * * * *